United States Patent [19]

Kovaleski

[11] 4,017,037

[45] Apr. 12, 1977

[54] TENSION BRUSH FOR WIRE SPOOL

[76] Inventor: Joseph J. Kovaleski, c/o Wyrepak Industries Inc., 136 James St., Bridgeport, Conn. 06604

[22] Filed: Mar. 31, 1975

[21] Appl. No.: 563,787

[52] U.S. Cl. ..... 242/129.8; 242/128; 242/147 R

[51] Int. Cl.[2] ..... B65H 49/00

[58] Field of Search ..... 242/128, 129.8, 147 R; 300/21, 1; 156/173

[56] References Cited

UNITED STATES PATENTS

| | | | |
|---|---|---|---|
| 1,548,898 | 8/1925 | Nielsen | 300/21 |
| 2,349,644 | 5/1944 | Wesemeyer | 300/21 |
| 2,397,471 | 4/1946 | Cox | 300/21 |
| 3,202,380 | 9/1973 | Hosbein | 242/128 |
| 3,323,960 | 6/1967 | Brown | 156/173 |
| 3,493,192 | 2/1970 | Hoard | 242/129.8 |
| 3,758,046 | 9/1973 | Jordan | 242/147 R |
| 3,811,639 | 5/1974 | Jordan | 242/129.8 |

*Primary Examiner*—Leonard D. Christian
*Attorney, Agent, or Firm*—H. Gibner Lehmann; K. Gibner Lehmann

[57] ABSTRACT

A tension brush assembly for facilitating the unreeling of wire from a wire-carrying spool, comprising a support body constituted of two annular members which are disposed broadside and in axial alignment with one another, and a plurality of flexible and resilient nylon tines which are clamped between the members with their outer ends being free and unattached, and which extend radially with respect to the body beyond outer peripheral edge portions thereof. The annular members are secured to one another by stitching which extends around the edge portions. Means are provided on the body to enable it to be mounted on one end of a spool, whereby the free ends of the tines extend beyond the spool flange portions. The arrangement is such that the tines prevent the wire from unravelling when the take-off speed is reduced or when the wire is halted. During normal take-off or unreeling, the wire sweeps past the flexible tines as the tension is either maintained constant or increased. As a result, excessive looseness and kinking of unreeling wire is greatly minimized.

9 Claims, 12 Drawing Figures

TENSION BRUSH FOR WIRE SPOOL

BACKGROUND

This invention relates to auxiliary equipment for facilitating the removal of reeled wire from wire-carrying spools.

In the past, a number of unreeling devices have been proposed and produced. Typically, such devices employed a disk that was carried at one end of the spool, with a series of flexible fingers or tines extending radially outward therefrom past peripheral portions of the spool flange. Generally, as the wire being unreeled was drawn past the periphery of the disk, it brushed by the flexible fingers, which tended to impart a drag to the wire.

A typical arrangement is disclosed in applicant's U.S. Pat. No. 3,425,647 issued Feb. 4, 1969, in which a disk carried at one end of a wire-carrying spool is provided with multiple embedded tines. While such an arrangement operated satisfactorily, the wide spacing between the tines did not offer the desired resistance to the free movement of the wire as the tension in it was reduced. In addition, the manufacture of a disk having multiple embedded tines similar to those disclosed in the above patent tended to be expensive. Also, with extremely thin wire, the use of a disk having widely spaced tines often did not provide adequate protection against kinking and excessive looseness.

The above disadvantages and drawbacks of prior devices of the above type are obviated by the present invention, which has for an object the provision of a novel and improved wire take-off device which is extremely simple in construction, reliable in operation, and which is constituted of readily available materials, thus resulting in a product which is exceptionally low in cost. In addition, it has been found to be very effective in preventing looseness and kinking of unreeling wire as the take-off speed is being reduced, or as the wire is being halted. The extreme simplicity of the device involves no special tooling, and accordingly the manufacture thereof can be readily modified to provide different configurations adaptable to various types of equipment as well as different sizes of wire spools. It is thus useable with a wide range of wire sizes and speeds.

The above objects are accomplished by a tension brush assembly for use with a wire-carrying spool, comprising a support body having a pair of annular members constituted of sheet material adapted to be placed one upon another, a multiplicity of flexible and resilient tines clamped between the members and extending radially outward beyond peripheral edge portions thereof, the outer ends of the tines being free and unattached, and means for securing the members together such that the inner portions of the tines are clamped therebetween. In a preferred embodiment, the members are stitched together at their outer peripheral portions, with the stitches also extending adjacent to portions of the radially disposed tines. Optionally, glue or cement is employed to secure the members together, as well as to retain the tines in fixed positions with respect thereto. Also, novel means are provided for releasably securing the tension brush assembly to a spool, thereby greatly simplifying the procedures involved with removal of wire therefrom.

Other features and advantages will hereinafter appear.

Figure 1:
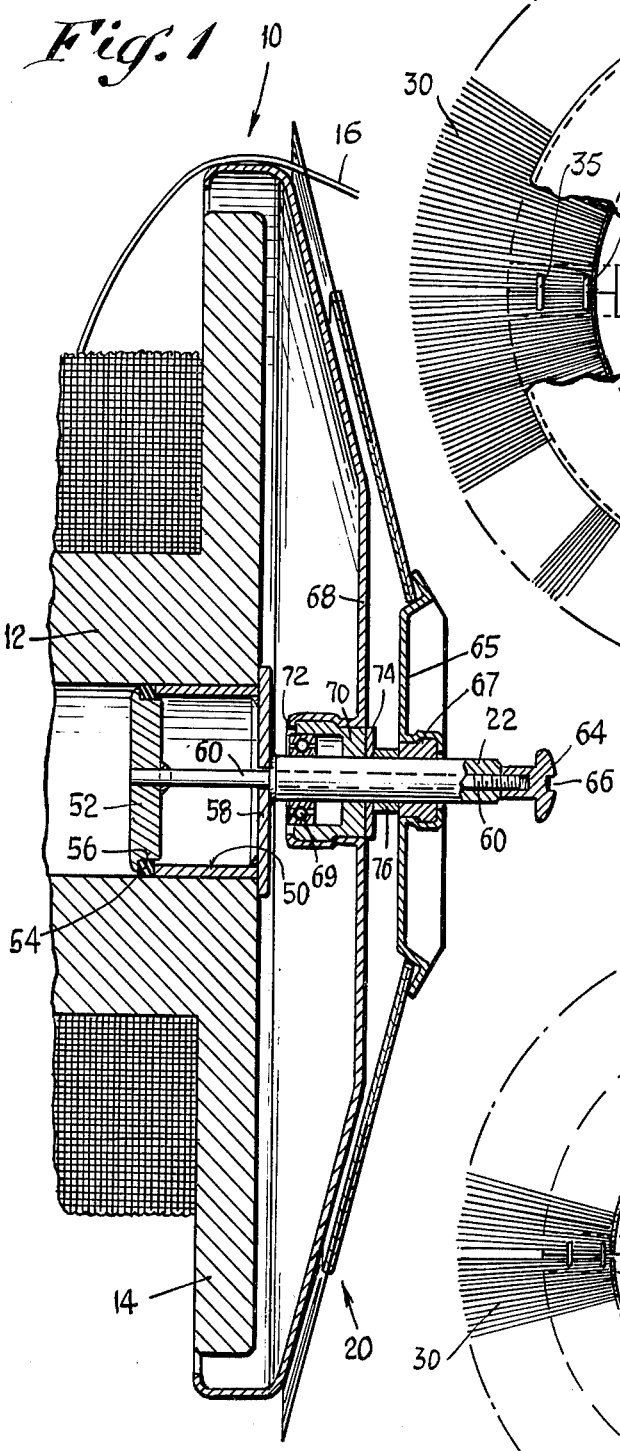
FIG. 1 is an axial sectional view of a wire-carrying spool incorporating the improved tension brush of the present invention, and showing unique means for mounting it at one end of the spool.

Referring first to FIG. 1, there is illustrated a wire takeoff apparatus generally designated by the numeral 10, comprising a wire spool 12 having a flange 14. The spool is shown as being partially filled with wire, a single strand 16 of which extends past the flange to another spool, an idler mechanism, or the like (not shown). The spool 12 is carried at its one end by a support fixture (not shown) extending part way into the hollow bore of the spool.

In accordance with the present invention there is provided a novel and improved tension brush assembly designated generally by the numeral 20, the assembly being carried at one end of the spool on a shank 22, which in turn, is secured to the free end of the spool by a unique support mechanism which will be described below.

Figure 2:
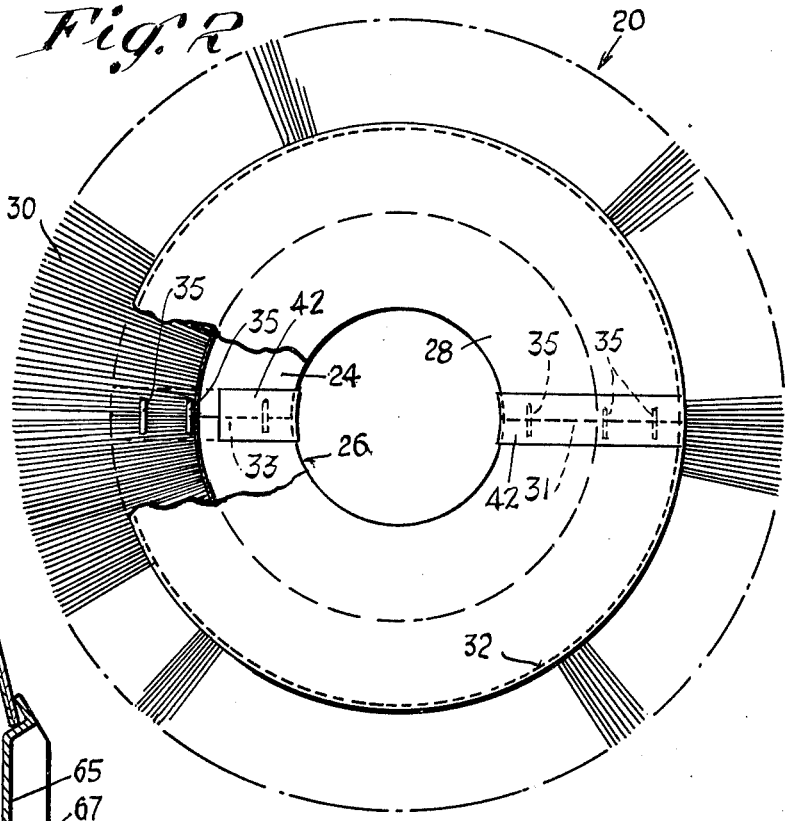
FIG. 2 is a side elevational view, partly broken away, of the tension brush of FIG. 1.
Figure 3:
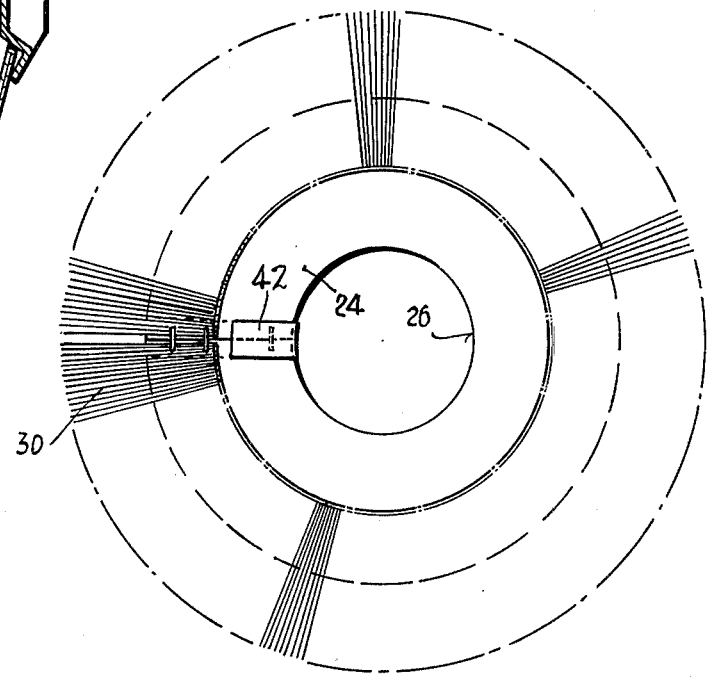
FIG. 3 is a side elevational view of the tension brush of FIG. 1, shown with one annular member removed so as to reveal details of its construction.

The tension brush 20 is particularly illustrated in FIGS. 2 and 3, and comprises a first annular member 24 in the form of a slightly conical disc, having a central aperture 26, together with a second annular member 28, substantially identical in construction to the first. The members 24 and 28 are juxtaposed to one another, such that their axes are substantially in alignment.

As particularly illustrated in FIG. 2, there is provided a plurality of radially extending tines 30 which may be constituted of nylon or other resilient yet flexible material.

The tines are sandwiched between the members 24 and 28, and extend a substantial distance past the peripheral edge portions thereof.

In accordance with the present invention, means are provided for securing the member 24 to the member 28 with the tines 30 disposed therebetween. As particularly illustrated in FIG. 2, a series of stitches 32 extends around the peripheral edge portions of the members and past adjacent pairs of tines 30. In addition, prior to the application of the stitches 32, suitable cement can optionally be applied to the inner surfaces of either of the members, such that when the two are assembled together, the glue encompasses the inner portions of the tines to thereby secure them in fixed, radial positions. While the members 24, 28 are of generally annular configuration, each has a radially extending slot designated 33, 31 respectively which enables the members to be formed into a slightly conical shape when assembled, as in FIG. 1. As shown in FIG. 2, the slot 33 of member 24 is diametrically opposite to the slot 31 of member 28 in the finished unit. The adjacent parts of the members on opposite sides of the slot are held together by a series of staples 35. Tape 42 may optionally be applied over the area of the joint, in order to present a finished appearance.

Figure 7:
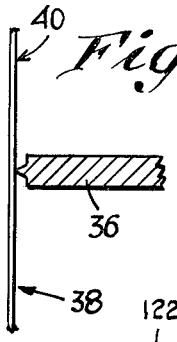
FIG. 7 shows an end view of the step illustrated in FIG. 6, wherein the heated blade is applied to the tines to fuse them together.
Figure 6:
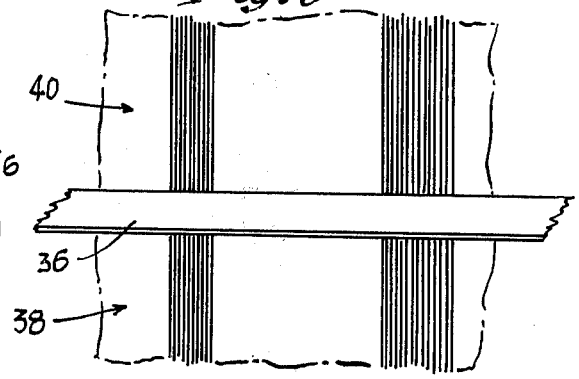
FIG. 6 illustrates a step involved with the manufacture of the tension brush of FIG. 1, wherein a series of nylon tines is placed side-by-side, and a heated blade impressed transversely on the tines so as to fuse adjacent portions thereof together.

The tension brush assembly of the invention is preferably constructed in accordance with procedures illustrated in FIGS. 6–12. Referring first to FIGS. 6 and 7, a series of tines is placed side-by-side in coextensive relation on a supporting surface, and a heated knife or blade 36 impressed across the tines so as to fuse their adjacent portions together. Preferably, the tines are constituted of nylon or other heat-softenable material, in order to enable this to be effected. At the same time that the fusing is accomplished, the tines are cut through, so as to form two brush-like assemblies having cut edge portions which are disposed back-to-back, the assemblies being designated by the numerals 38 and 40, respectively.

Figure 8:
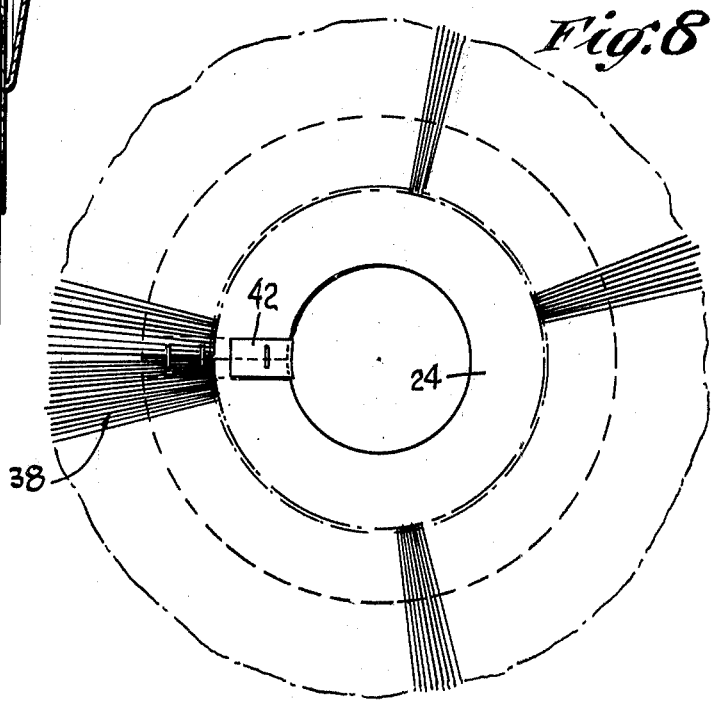
FIG. 8 shows still another step, wherein one of the brush-like assemblies created by the step shown in FIG. 6 is formed into an annulus and placed upon an annular member, with the free ends of the assembly temporarily held in place by staples.
Figure 9:
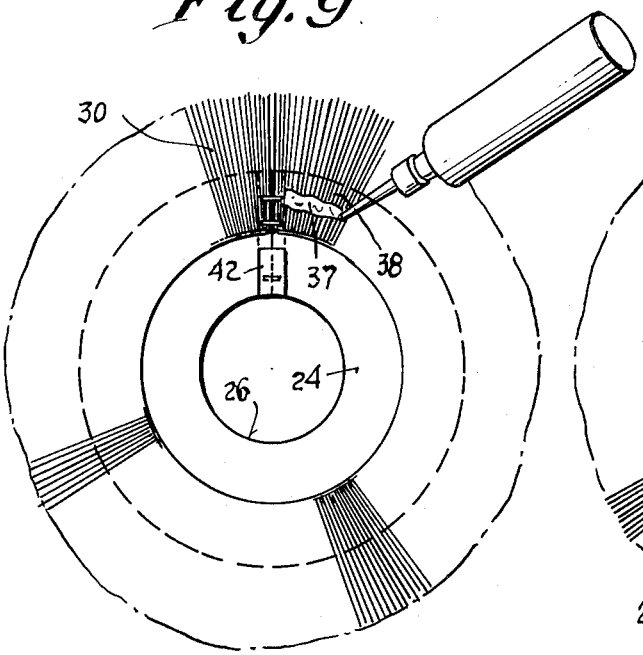
FIG. 9 shows another step, wherein the annulus is glued to the disk, while being held in place by the staples.
Figure 10:
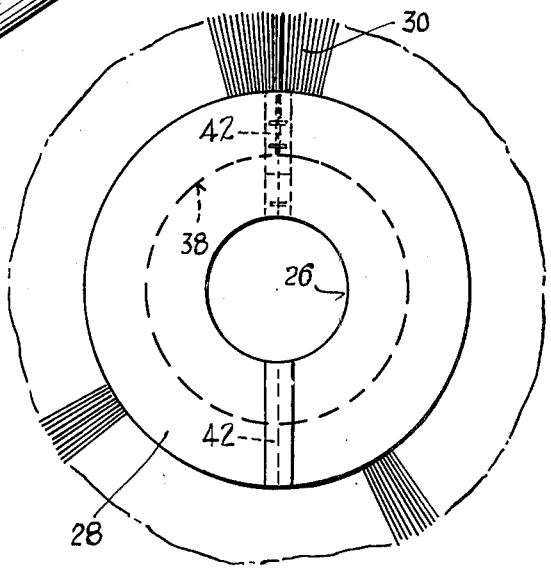
FIG. 10 shows yet another step, wherein a second annular member is placed over the tines and first annular member, while the glue is still wet, the tines being sandwiched between the two members.
Figure 11:
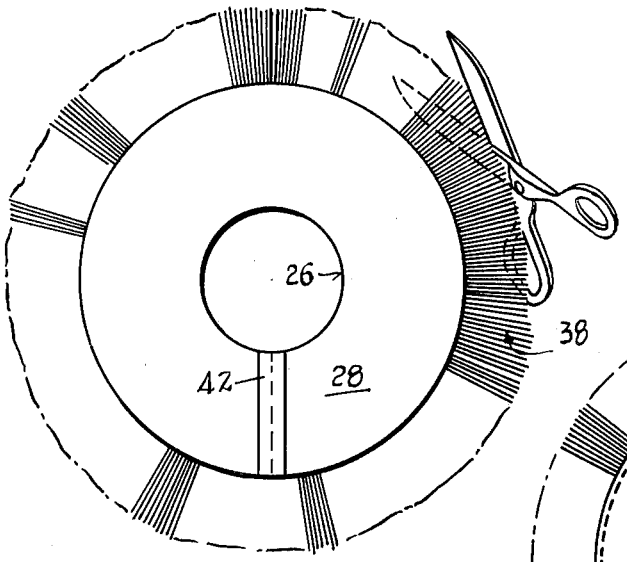
FIG. 11 shows still another step, wherein the free ends of the tines are trimmed to a uniform length.
Figure 12:
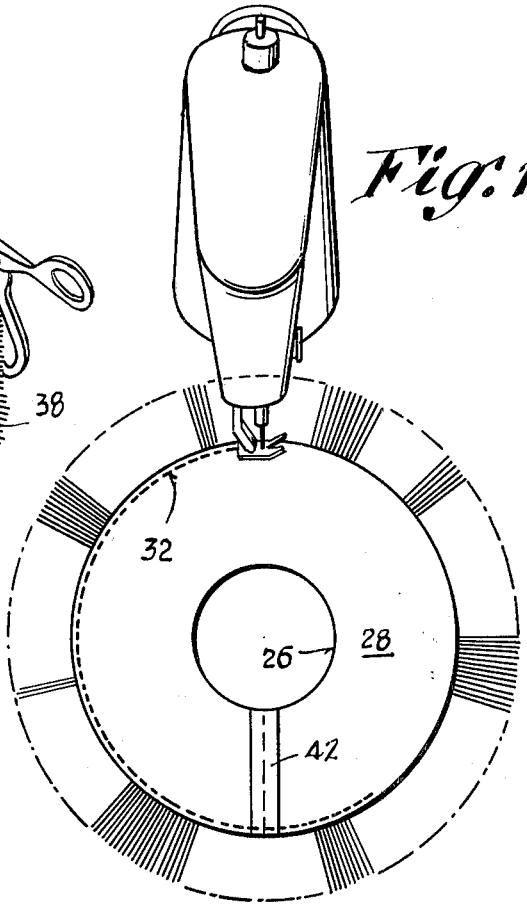
FIG. 12 shows yet another step, wherein the two annular members are stitched together along their peripheries, with some of the stitches extending between adjacent pairs of tines of the brush, respectively.

Next, as illustrated in FIG. 8, either one of the assemblies 38, 40 is formed into an annular brush and placed over the annular member 24, with the free ends of the assembly being joined together to form a circular brush. Then, the free ends are stapled as in FIG. 8 so as to hold them in position. Next, in FIG. 9, suitable glue or cement 37 is applied to the assembly 38. The glue is allowed to settle and thus fill the spaces between the tines, some of the glue flowing past the spaces between the tines, and onto the annular member 24. As illustrated in FIG. 10, the second member 28 is then placed over the first, preferably before the glue has completely dried, and as shown in FIG. 12 a series of stitches 32 applied to the peripheral portions of the assemblage consisting of the members 24, 28 and tines 30. FIG. 11 illustrates the final step, wherein the tines are trimmed to a suitable uniform length. In FIG. 7 two brush-like assemblies 38, 40 are produced, adapted for constructing two tension brushes of the kind illustrated in FIGS. 1–3.

Referring again for the moment to FIG. 1, by the present invention there is provided a novel fastening means for securing the tension brush 20 to one end of the spool. The fastening means comprises a hub fitting 50 which is adapted to be received in the free end of the spool with a sliding fit, a compression plate 52 having a resilient expander ring in the form of an O-ring 54 disposed against a peripheral groove 56 in the disc, and an actuator mechanism for effecting movement of the compression plate 52 in an axial direction with respect to the hub fitting 50. As shown, the latter has an end plate 58 which abuts the flange 14 of the spool, the end plate 58 being preferably welded to the hub. This plate 58 is in turn welded to the shank 22 which carries the tension brush 20. Welded to the plate 52 is a screw 60, extending through a hollow portion of the shank and being engagable with a nut 64 having a slot 66 adapted for engagement by a suitable screwdriver. By such an arrangement, it is readily seen that as the nut 64 is tightened, the screw 60 will advance toward the right in FIG. 1, causing the compression plate 52 to squeeze the O-ring 54. This in turn causes the latter to expand and thus frictionally engage the bore of the spool. As a result, the hub fitting 50 is permanently, yet releasably retained on the free end of the spool, and can be quickly and easily installed or removed with a minimum of time and effort.

In FIG. 1, there is illustrated an additional hub 65 secured to the shank 22 by means of a friction bushing 67, the hub 65 carrying the tension brush 20. During normal operation of the device, the tension brush 20 is non-rotating with respect to the spool. In addition, a turnably mounted wheel 68 is provided on the shank 22, carried on a ball bearing 69 and bushing 70. The latter is pressed into the center portion of wheel 68, and the free edge 72 thereof crimped over the bushing. As shown in FIG. 1, the shank 22 carries a washer 74 and a spacer bushing 76 which maintain the tension brush 20 spaced from the freely rotating wheel 68.

By such an arrangement, as wire is unreeled from the spool 12 (which is stationary), the wheel 68 can freely rotate under the action of the wire, thereby facilitating smooth pay-out and eliminating any tendency for the flange 14 of the spool to become worn. As shown in FIG. 1, the extreme outer ends of the tines extend slightly past the edge of the wheel 68. With the tension brush 20 stationary, it will be seen that as the wire unwinds from the spool, it flexes the tines as it brushes past them. Thus there there is eliminated all looseness and kinking in the event that the wire speed is reduced or halted, due to the slight drag imparted to the wire by the tines.

I have found the above brush construction to be extremely effective in overcoming the problems which are normally associated with variable speed pay-out of wire from master spools and the like.

Figure 4:
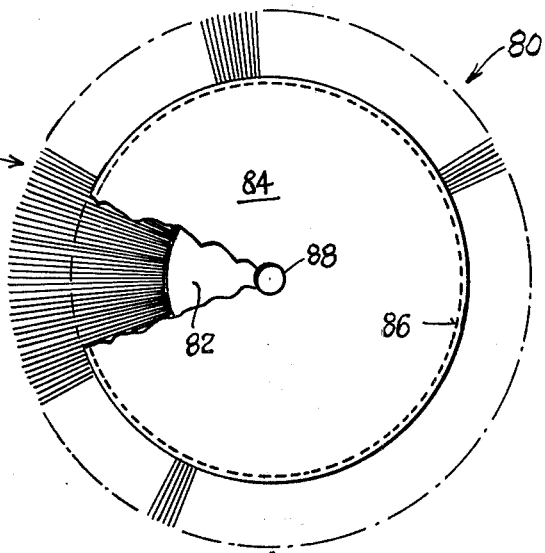
FIG. 4 is a side elevational view, partly broken away, of a somewhat modified tension brush, constituting another embodiment of the invention.
Figure 5:
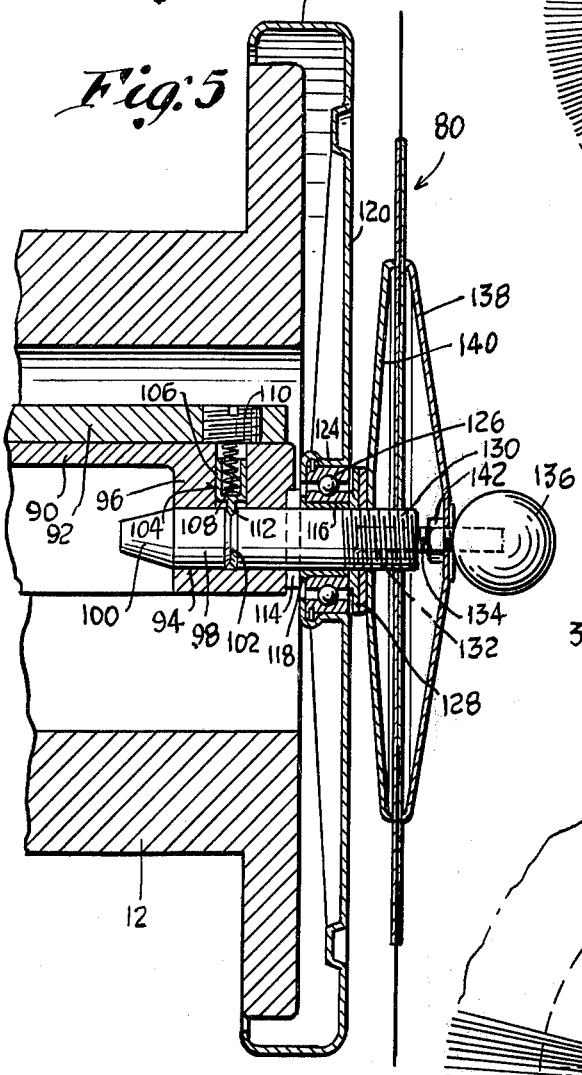
FIG. 5 is an axial sectional view of the brush of FIG. 4, and showing an arrangement for supporting it at one end of a wire-carrying spool.

Another embodiment of the invention is illustrated in FIGS. 4 and 5 showing a modified tension brush assembly generally indicated by the numeral 80, comprising a pair of substantially flat annular numbers 82, 84 having their axes in alignment with one another, together with a multiplicity of radially extending tines in the form of a brush-like assembly 38 of tines 30, which is substantially identical to that previously illustrated and described. As in the previous embodiment, the members 82, 84 are disposed one against the other, with the brush-like assembly of tines 30 sandwiched therebetween. In addition, a series of stitches 86 extends around peripheral edge portions of the brush 80 in order to secure the members 82, 84 together with the brush-like assembly sandwiched therebetween. A central aperture 88 is provided for facilitating mounting of the tension brush adjacent one end of a wire-carrying spool.

FIG. 5 shows a typical arrangement, including a spool 12 having the improved tension brush 80 carried at one end.

The spool 12 rests on a horizontal support 90 having an upper plate 92, the edges of which are adapted to engage the bore of the spool at circumferentially spaced points therein. Disposed at one end of the support 90 is an end wall 96 having an aperture 94 which receives a shaft or pin 98 having a tapered nose portion 100. The pin 98 has a transverse groove 102. The end wall 96 is provided with a lateral passage 104 which carries a spring-biased cup 106 and spring 108, the latter being held in place by means of a cap screw 110. The cup 106 has a nose portion 112 which is adapted to be received in the transverse groove 102 of the shaft 98 as the latter is inserted into the aperture 94 from right to left in FIG. 5.

The shaft 98 carries a transverse pin 114 which bears against a bushing 116 having a shoulder 118. Also carried on the shaft 98 is a freely-rotatable wheel 120 having a C-shaped peripheral flange 122 and central hub 124. The latter is carried by a ball bearing 126 having an inner race into which the bushing 116 is pressed. In addition, the end portion 130 of the shaft 98 is threaded, and receives two washers 128 which engage one side of the bearing 126.

The outer end of the shaft 98 is provided with an axial bore 132 which is adapted to receive a screw 134 having a manually-engageable nob 136. A pair of supporting plates 138, 140 is provided, both being of annular configuration, the plate 140 being adapted to bear against one washer 128 in FIG. 5, and the plate 138 being secured by means of a nut 142 which is tightened against the nob 136. As can be readily understood, both plates 138, 140 are slightly pre-stressed, that is, their center portions are clamped toward one another so as to frictionally retain the body of the tension brush 80 in a fixed position with respect to the spool. As shown, a space exists between the right-hand end of the shaft 98 and the nut 142 in FIG. 5, this enabling adjustment of the pressure exerted by the plates 138, 140 against the tension brush body. As shown, the tines 38 extend slightly beyond peripheral edge portions of the flange of the spool 12.

In operation, the wire-carrying spool 12 can be placed over the support 90 in a fixed position. The assembly consisting of the shaft 98, wheel 120, and tension brush 80 can be merely snapped into place by the operator. During insertion, the conical nose portion 100 of the shaft 98 momentarily biases the cup 106 to a retracted position as the shaft is inserted, until the nose portion 112 of the cup 106 becomes seated in the transverse groove 102. As wire is removed from the spool, the strand (not shown) passes over the peripheral C-shaped flange 122 of the wheel 120, the latter being capable of undergoing free-rotation as this is done, with the strand brushing past the nylon tines. As in the previous embodiment, the arrangement is such that changes in the tension in the wire due to changes in the speed of pay-out do not give rise to undesirable looseness and kinking of the wire. The wire then passes to an idler pulley or take-up spool (not shown). Otherwise the operation of this embodiment is similar to that illustrated and described in connection with the embodiment of FIG. 1.

From the above it can be seen that I have provided a novel and improved tension brush assembly and mounting arrangement therefor, both of which are simple in construction, extremely low cost, and sufficiently flexible to enable them to be readily adaptable to different sizes and types of equipment.

The device is thus seen to represent a distinct advance and improvement in the technology of wire take-off devices.

Variations and modifications are possible without departing from the spirit of the invention.

I claim:

1. A tension brush assembly for use with a spool wound with wire, comprising in combination:

a. a support structure comprising a pair of circular disklike members constituted of sheet material adapted to be disposed broadside to each other in axial alignment, b. a multiplicity of flexible and resilient tines disposed between the members and extending radially thereof beyond the outer peripheral edge portions of the members, and c. means disposed in a generally circular configuration and extending adjacent the outer peripheral edges of the members, for securing the same together to clamp inner end portions of the tines therebetween, d. the outer ends of the tines being free and unattached, and said structure having means adapted to mount it at one end of a spool, e. said tines being constituted of heat-softenable material, all portions of said tines being disposed radially, and the adjoining inner end portions of the tines being integrally secured to each other solely by being heat-fused together.

2. The invention as defined in claim 1, and further including:

a. a hub carrying the support structure at the center thereof, b. said hub being adapted to be carried by a shaft having an axis coincidental with the axis of the spool.

3. The invention as defined in claim 1, wherein:

a. the circular members each comprise a disc having a central aperture, the walls of said aperture and adjoining portions of the members constituting said mounting means.

4. The invention as defined in claim 1, and further including:

a. a spool, and b. means for releasably securing the tension brush assembly to the spool such that the tines are adjacent one flange thereof.

5. The invention as defined in claim 1, wherein:

a. said tines are characterized by a cut edge portion at the area of the heat-fused inner edge portions thereof.

6. A tension brush and spool assembly, comprising in combination:

a. a support structure comprising a pair of circular disklike members constituted of sheet material adapted to be disposed broadside to each other in axial alignment, b. a multiplicity of flexible and resilient tines disposed between the members and extend radially thereof beyond the outer peripheral edge portions of the members, the outer ends of the tines being free and unattached, c. means disposed in a generally circular configuration and extending adjacent the outer peripheral edges of the members, for securing the same together to clamp inner end portions of the tines therebetween, d. a spool, e. means for releasably securing said support structure to the spool such that the tines are adjacent one flange thereof, f. said spool having an axial bore, g. said securing means comprising a hub receivable in the bore, h. a resilient expander ring carried on said hub and engageable with the walls of the bore, and i. manually-operable means carried by said hub for effecting tight frictional engagement of the expander ring with the walls of the bore to thereby securely hold the hub in a fixed position with respect to the spool.

7. A tension brush and spool assembly, comprising in combination:

a. a support structure comprising a pair of circular disk-like members constituted of sheet material adapted to be disposed broadside to each other in axial alignment, b. a multiplicity of flexible and resilient tines disposed between the members and extending radially thereof beyond the outer peripheral edge portions of the members, the outer ends of the tines being free and unattached, c. means disposed in a generally circular configuration and extending adjacent the outer peripheral edges of the members, for securing the same together to clamp inner end portions of the tines therebetween, d. a spool, e. means for releasably securing said support structure at one end of the spool such that the tines are adjacent one flange thereof, f. said spool having an axial bore, g. means extending into the bore of the spool for supporting the same, h. said securing means comprising a shaft carrying the support structure and means providing a socket for receiving said shaft, and i. yieldable detent means in said socket and on said shaft for holding the latter captive therein.

8. The invention as defined in claim 6, wherein:

a. said hub has a shoulder against which one side of the ring bears, b. said manually operable means comprising a compression plate engaging the other side of the ring, and c. screw means carried by said hub, for effecting axial movement of the compression plate with respect thereto, and for axially compressing the ring, thereby causing its radial expansion into frictional engagement with the walls of the bore.

9. The invention as defined in claim 7, wherein:

a. said yieldable detent means comprises a transverse grooved formation on said shaft, and b. a spring-biased detent plunger carried by said socket and receivable in the transverse grooved formation.

* * * * *